US005294179A

United States Patent [19]

Rudes et al.

[11] Patent Number: 5,294,179

[45] Date of Patent: Mar. 15, 1994

[54] RETROFITTABLE CHAIR LIFTING AND TILTING DEVICE

[75] Inventors: Arnold H. Rudes, Amherst; Robert F. Hand, Grand Island, both of N.Y.

[73] Assignee: Hand Machine Company, Inc., North Tonawanda, N.Y.

[21] Appl. No.: 881,063

[22] Filed: May 11, 1992

[51] Int. Cl.[5] ..... A47C 1/00

[52] U.S. Cl. ..... 297/330; 297/325; 297/328; 297/DIG. 10; 248/396

[58] Field of Search ..... 5/509.1; 297/325, 328, 297/330, DIG. 10; 248/396, 397

[56] References Cited

U.S. PATENT DOCUMENTS

| | | | |
|---|---|---|---|
| 1,103,796 | 7/1914 | McCoon . | |
| 2,469,048 | 5/1949 | Manke | 254/5 |
| 3,048,366 | 8/1962 | Williamson | 254/5 |
| 3,218,102 | 11/1965 | Specketer | 297/330 |
| 3,250,569 | 5/1966 | Gaffney | 297/DIG. 10 X |
| 4,083,599 | 4/1978 | Gaffney | 297/131 |
| 4,715,073 | 12/1987 | Butler | 5/509.1 X |
| 4,838,612 | 6/1989 | Cross | 297/338 |
| 4,852,939 | 8/1989 | Krauska | 297/DIG. 10 X |
| 4,946,222 | 8/1990 | Matson | 297/345 |
| 4,993,777 | 2/1991 | LaPointe | 297/325 |
| 5,061,010 | 10/1991 | LaPointe | 297/325 |
| 5,165,753 | 11/1992 | Henderson | 297/DIG. 10 X |

*Primary Examiner*—Michael F. Trettel
*Attorney, Agent, or Firm*—Howard M. Ellis

[57] ABSTRACT

A power lifting and tilting device is more universally adaptable for economic retrofitting to most types of chairs as assists for the infirm. Little or no floor clearance requirements are achieved with power driven rollers traveling oppositely inclined surfaces of the device to produce lifting and tilting action for alighting from and occupying the chair.

19 Claims, 3 Drawing Sheets

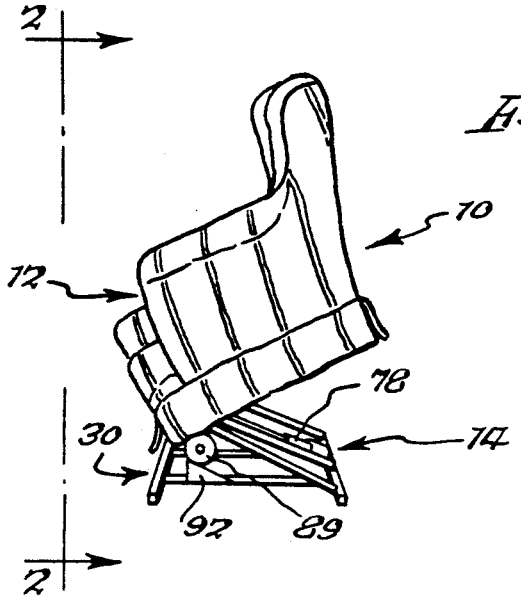
Fig. 1.
Fig. 2.
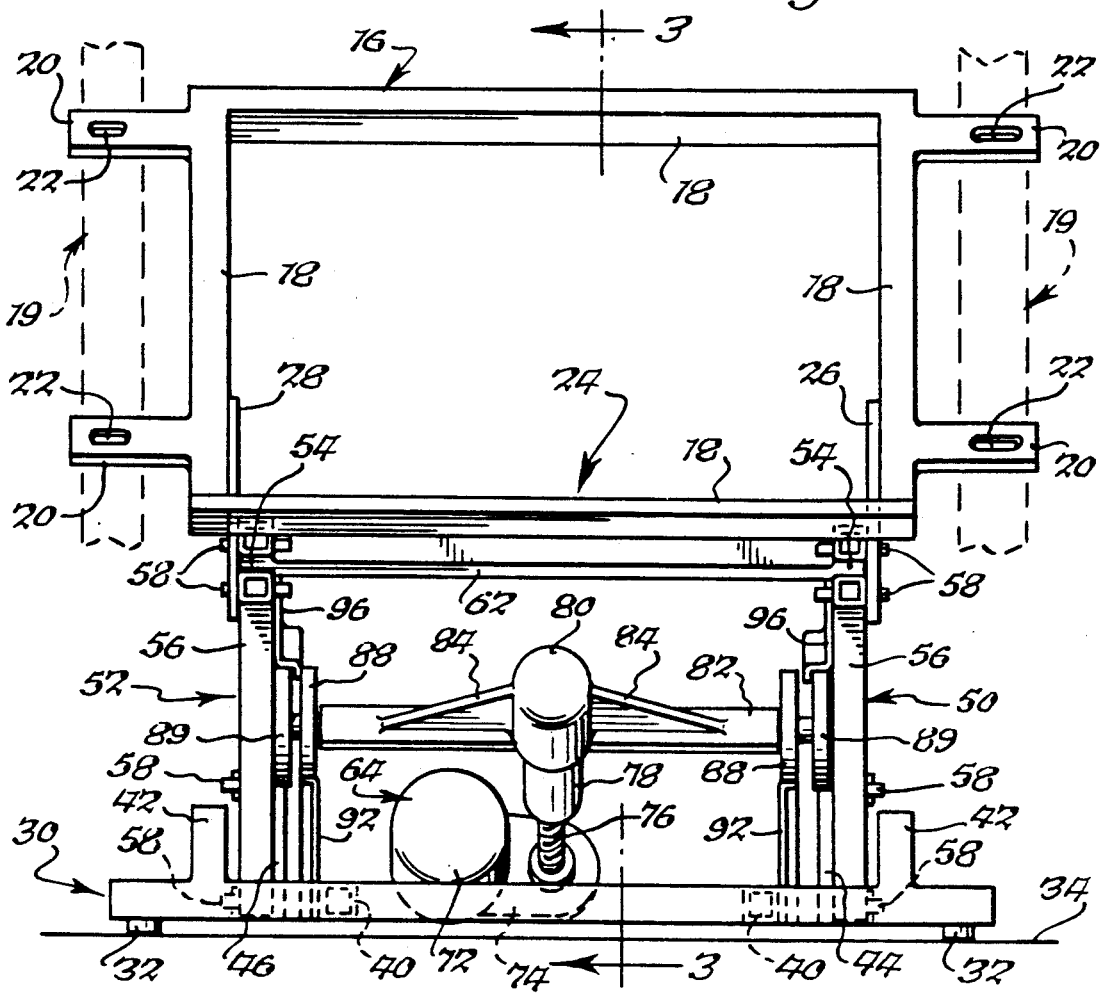

Fig. 5.
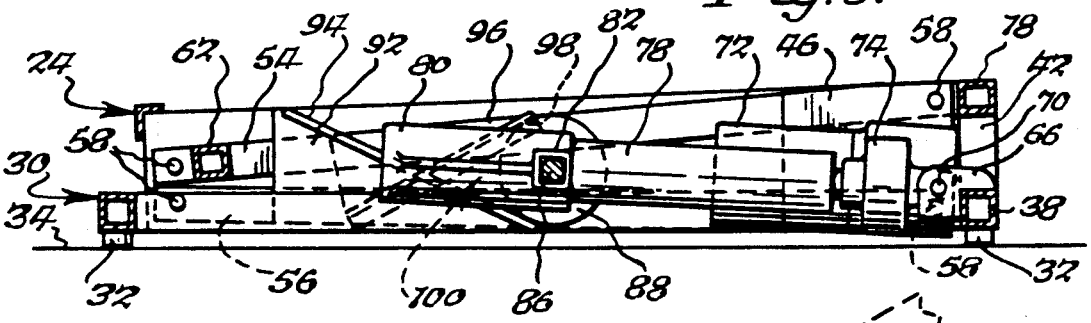
Fig. 3.
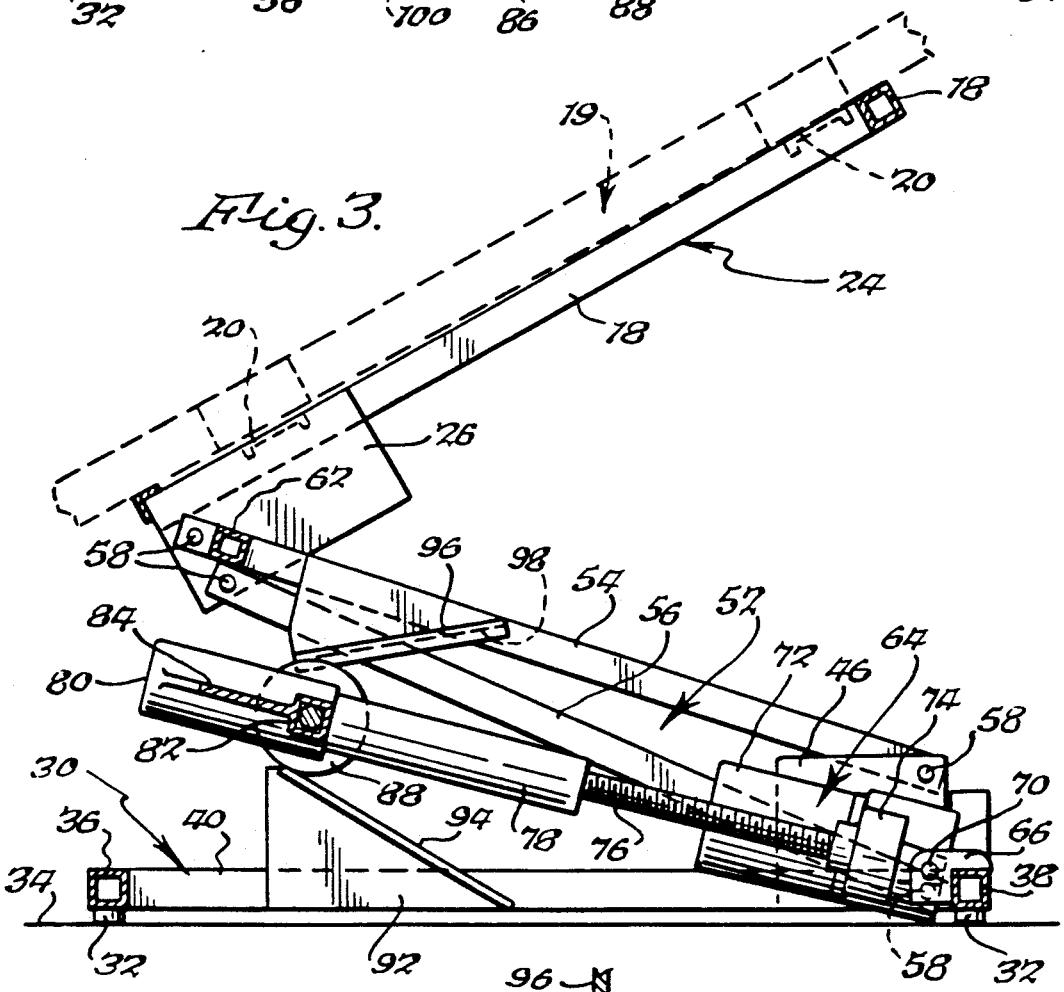
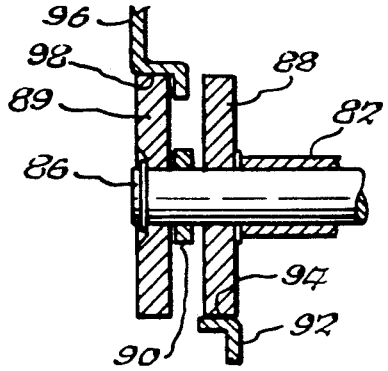
Fig. 7.

RETROFITTABLE CHAIR LIFTING AND TILTING DEVICE

BACKGROUND OF THE INVENTION

The present invention relates generally to power seating assists for the infirm, and more specifically, to devices for lifting and tilting in assisting the elderly and disabled in both sitting and alighting from a chair.

Upholstered chairs with lifting/seating assists for the infirm have been commercially available for some time. Those most widely available are marketed as specialty appliances with the lifting mechanism as an integral unit built-in an upholstered chair at the time the chair is manufactured. Consequently, one in need of such an appliance frequently purchases at considerable expense a complete chair and lifting device as a unit. U.S. Pat. Nos. 3,218,102; 4,838,612 and 5,061,010 disclose representative examples of power assisted chairs with the lifting and/or tilting devices as integral units built into the chair.

While such integral power lifting/seating chairs perform quite satisfactorily, a more economic alternative is frequently needed. One such alternative would be the installation or retrofitting of a previously manufactured chair owned by the infirm with a power lifting/seating assist device. However, retrofittable chair lifting and tilting devices have had some significant disadvantages, and consequently, they have had only limited acceptance. For example, U.S. Pat. No. 4,083,599 (Gaffney) discloses a power chair lifting and tilting device with the ability of the device to lift off the floor when fully retracted. This permits an accessory base on the chair having wheels or rocker springs to engage with the floor. However, this chair lifting and tilting device includes a upper frame member which requires a hollow recess in the base of the chair. This additional clearance space is also needed to accommodate a power actuated ram for the lifting device. Hence, the chair lifting and tilting device of U.S. Pat. No. 4,083,599 is not universally adaptable to all chairs, and especially to upholstered chairs having low floor clearances.

Accordingly, it would be highly desirable to have an improved retrofittable chair lifting and tilting device, including one which would be more universally adaptable to most previously manufactured chairs, and can be easily installed without requiring structural modifications to the chair.

SUMMARY OF THE INVENTION

It is thus a principal object of the invention to provide a power seating/lifting device for a chair, and more specifically, a lifting and tilting device for a chair which can be installed at the time the chair is manufactured, or easily retrofitted in particular to an upholstered chair without requiring structural alterations to the chair.

For purposes of this invention terms like "retrofit", "retrofitted" or "retrofitting" are intended to mean installing the device on a chair subsequent to the time the chair is manufactured. The term "retrofittable" is intended to mean the same as the term "retrofit", but in addition the device as disclosed and claimed herein is also suitable for installation at the time the chair is manufactured.

The chair lifting and tilting device has a lower main frame for resting on a support surface and an upper supporting platform for engaging with a chair. The lower main frame and the upper supporting platform have front and rear sections corresponding respectively to the front and rear sections of the chair. Also included are right and left linking arms pivotally connected to the lower main frame and upper supporting platform for forwardly tilting the upper supporting platform as it is elevated relative to the lower main frame. Other especially key elements of the device include a plurality of wedge shaped lifts or cam elements having oppositely inclined surfaces as tracks positioned between the upper supporting platform and lower main frame. Rollers driven by a motor engage the inclined surfaces/tracks on the cam elements to wedge apart the cam elements to actuate the upper supporting platform.

For purposes of this invention it should be understood that expressions like "oppositely inclined surfaces" or "oppositely inclined planes" as recited in the specification and claims are intended to be generic terms referring to inclined surfaces or planes positioned generally across from each other. That is to say, the inclined surfaces, for example, may face one another in the same plane. In addition, oppositely inclined surfaces or planes are intended to encompass those which are across from one another, but not facing in the same vertical plane. Instead, they are positioned in laterally adjacent or parallel planes which are offset.

Thus, according to the present invention a chair mounted on the upper supporting platform of the device can be elevated and forwardly tilted by advancing rollers against pairs of wedges or cam shaped elements and lowered by withdrawing the rollers from the cam elements. The cam elements with oppositely inclined surfaces and a plurality of rollers operating in tandem offer the advantage of an unusually compact lifting and tilting device with a retracted height of only about 4.5 inches (11.4 cm) measured from the lower main frame to the upper supporting platform.

It is thus a further principal object of the invention to provide a retrofittable chair lifting and tilting device for installation to chairs having only minimal floor clearance. Furthermore, because the base or lower frame of the chair is mounted directly on the upper supporting platform of the device with none of the components of the device exceeding the height of the upper supporting platform in either a lifted or retracted position the device is more universally adaptable for installation to a wider variety of chairs. Accordingly, the device has the advantage of not having clearance requirements in the chair super structure for installation. Hence, the device is more universally adaptable for retrofitting.

Thus, it is yet a further object to provide an improved lifting and tilting device for retrofitting to a chair without requiring structural alterations to the chair. This includes devices comprising a lower main frame for resting on a supporting surface and an upper chair platform for engaging with the bottom of a chair. The lower main frame and upper chair platform have front and rear sections corresponding respectively to the front and rear of the chair. Right and left irregular or non-parallelogram linkage arms are pivotally connected to the rear section of the lower main frame and front section of the upper chair platform for forwardly tilting the upper chair platform as it is elevated relative to the lower main frame. The device includes pairs of first and second cam elements having oppositely inclined surfaces which can be laterally offset from one another. The first cam elements are spaced relative to one another and mounted in dependency relationship to the linkage arms. The second cam elements are spaced relative to one another and mounted upwardly to the lower main frame. Rollers are rotatably mounted on a cross shaft and spaced so each engages an inclined surface on the cam elements. A motor and drive shaft are employed for advancing the cross shaft and rollers for wedging apart the cam elements thereby actuating the upper chair platform.

A still further object of the invention is to provide a more stable power assisted lift chair by mounting a chair to the improved lifting and tilting device as described herein.

These and other objects, feature and advantages of the invention will become more apparent from the detailed written description below. However, for a further understanding of the invention, reference should first be made to the accompanying drawings taken in conjunction with the detailed written description below wherein:

FIG. 1 is a perspective view of the power assisted lift chair in an elevated forwardly tilted position mounted on the retrofittable chair lifting and tilting device.

FIG. 2 is a front elevational view of the lifting and tilting device taken along line 2—2 of FIG. 1, but with the chair removed.

FIG. 3 is an elevated side sectional view of the device taken along line 3—3 of FIG. 2.

FIG. 5 is a side sectional view of the device taken along line 5—5 of FIG. 4.

FIG. 7 is a fragmentary view of the cross shaft and rollers wedged between the oppositely inclined surfaces of the cams.

DETAILED DESCRIPTION ON THE INVENTION

Figure 4:
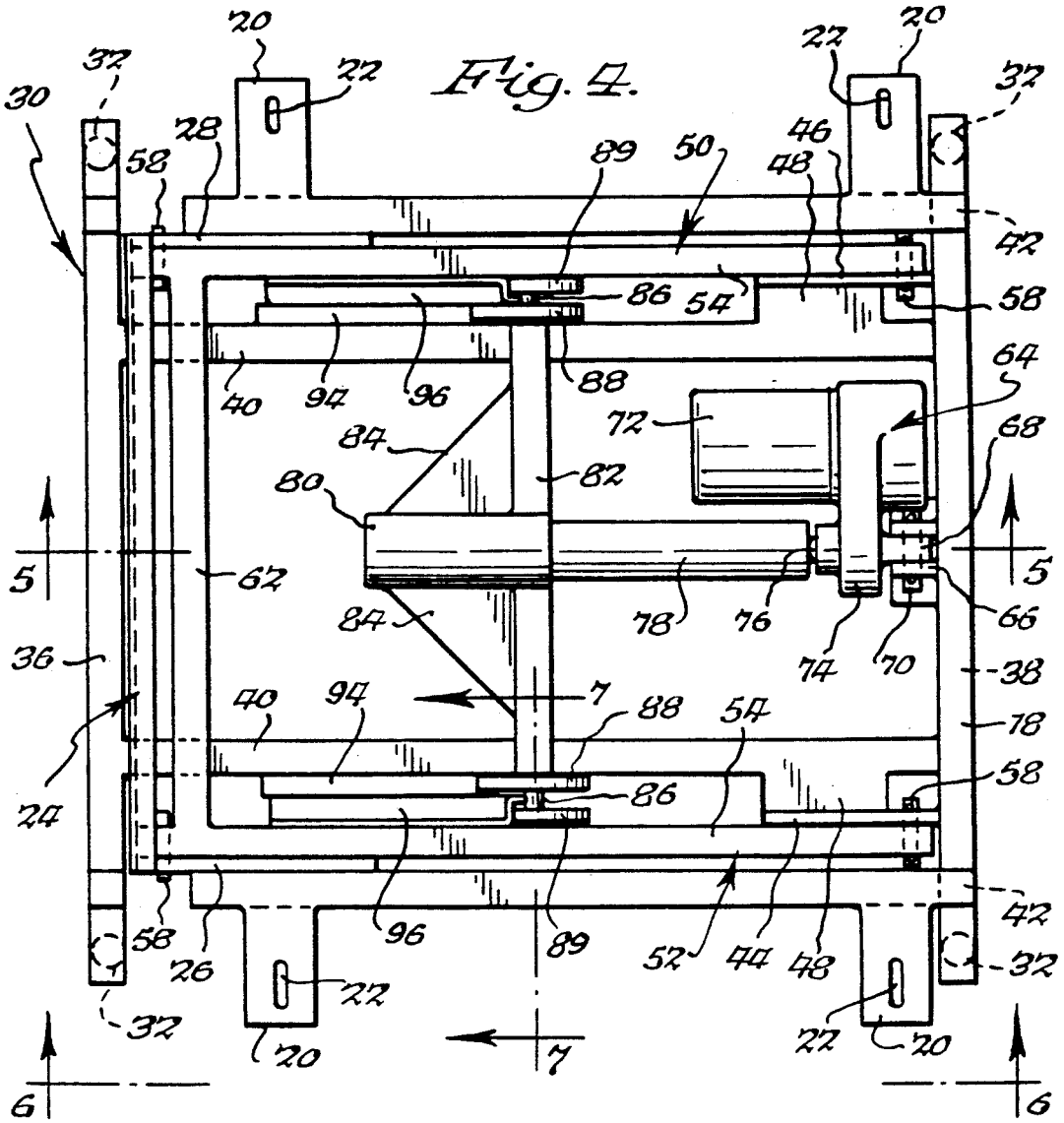
FIG. 4 is a top plan view of the chair lifting and tilting device fully retracted in a down/sitting position.

Turning first to FIG. 1, there is shown a power assisted lift chair 10 comprising a chair lifting and tilting mechanism 14 mounted to the undercarriage of chair 12. Chair 10 is primarily intended as an assist for convalescing, invalid and handicapped persons in alighting from, as well as in occupying the chair. While chair 12 is shown in an elevated position raised in a generally vertical path the lifting mechanism 14, which will be discussed in greater detail below, is capable of also tilting the chair forwardly without loss of stability in order to transfer the center of gravity over the occupant's feet. By so doing, the occupant experiences improved stability in alighting from or in occupying the chair. The power assisted lift chair helps avoid the need of such users having to perform the difficult procedure of assuming the posture and expending the energy and physical strain normally associated with occupying and alighting from a chair. Regardless whether in an elevated (standing) position or in retracted seating position the chair remains stable and not subject to tipping.

Operation of the power assisted lift chair between a lowered/retracted seating position where the occupant assumes a normal seated posture and to an elevated standing-like position as shown in FIG. 1 enabling the occupant to exit the chair, are maneuvers which can be performed by the occupant using a hand held or chair mounted wired remote control switch of conventional design (not shown).

The chair is mounted on a rigid platform 16 (FIG. 2) which is generally rectangular in shape. Platform 16 is reinforced and made stable by rigid welded tubular steel bars 18. The peripheral edge of the bottommost part of chair frame 19 (FIGS. 2-3) shown in partial view by broken lines is bolted to platform 16 through multiple mounting flanges 20 having expanded openings 22 for threaded connectors (not shown). The frontal portion 24 of platform 16 has right and left support plates 26-28 positioned dependently relative to the platform (see FIGS. 2-3) and welded thereto at the inside edge. Plates 26-28 impart added lift stability to the power assisted chair.

The device includes a main frame 30 with contacts 32 for engaging with floor 34. As best shown by FIG. 4, main frame 30 consists of a frontal support bar 36, rear support bar 38 and double inwardly indented welded cross bars 40 running between the frontal and rear support bars. This provides the main frame with a generally roman II configuration. Rear support bar 38 includes a pair of vertically mounted bearing blocks 42 (FIGS. 2-5 and 6) for supporting the weight being carried by platform 16 when the power assisted lift chair is fully retracted to a sitting mode. The double cross bars 40 of main frame 30 in proximity to rear support bar 38 have right and left upright support plates 44-46 affixed thereto through welded connectors 48. Support plates 44-46 provide further stability to the device especially when elevated.

Main frame 30 is connected to the chair supporting platform 16 through right and left irregular or non-parallelogram double linkage arms 50-52 (FIGS. 2-3). Each set of linkage arms consist of upper and lower arms 54-56. The right and left irregular parallelogram double linkage arms 50-52 are pivotally connected at a first end to right and left upright support plates 44-46 at the rear section of the device with separate connecting pins 58 running through openings 60. Double linkage arms 50-52 at a second end are also pivotally connected to platform 16 at front portion 24 of the device through right and left dependent support plates 26-28.

Figure 6:
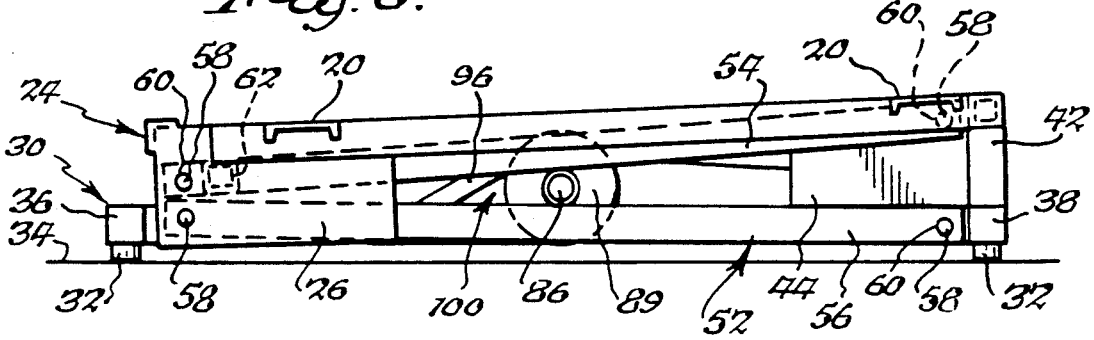
FIG. 6 is a side view of the device retracted in a down position taken along line 6—6 of FIG. 4.

Openings 60 on support plates 26-28 and 44-46 are aligned in the same vertical plane when the retrofittable chair lift device is in a retracted or sitting mode (FIGS. 5-6). However, it will be noted that openings 60 on right and left upright support plates 44-46 are spaced further apart than openings 60 on the dependent support plates 26-28. This provides the irregular parallelogram configuration to the double linkage arms and tilting action to platform 16 as it is elevated. That is to say, by elevating platform 16 in a generally arc-like path the effective length of lower arm 56 is reduced relative to the upper arm 54 while moving with the upper arm to cause the platform and chair affixed thereto to tilt forwardly (see FIG. 3).

To provide even greater lateral stability to the power assisted lift chair especially when elevated a cross bar 62 (FIG. 4) can be affixed by welding to upper arms 54 of the right and left irregular parallelogram linking arms 50-52.

In order to accomplish movement of the chair platform 16 relative to the lower main frame 30 a motorized linear actuator 64 is pivotally mounted to bifurcated support 66 (FIG. 4) on rear bar 38 through a rigid link 68 at the backside of the actuator. A connecting pin 70 pivotally affixes the actuator to the main frame. Actuator 64 consists of a reversible electric motor 72, a gear box 74 and a rotating screw shaft 76 and a sleeve 78 which travels forwardly and rearwardly depending on the direction of rotation of the screw shaft. A wired remote switch of conventional design (not shown) for actuating motor 72 can be mounted on the chair or be hand held. Actuators of the type shown are commercially available through ordinary channels of commerce. Hubbell Corporation, Kenosha, Wis., for example, markets a suitable parallel shaft linear actuator.

The terminal end portion of sleeve 78 projects into a locking cap 80 having a non-rotatable cross shaft 82 with reinforcing members 84. The terminal portions of cross shaft 82 have non-rotatable end shaft portions 86 of reduced diameter for installation of spaced rotatably mounted inner rollers 88 and outer rollers 89. The inner rollers are separated from the outer adjacent rollers by means of spacers 90 (FIG. 7).

Each roller is arranged on end shaft portions 86 to coincide and travel on an inclined plane surface on a cam element. Dual lower cam elements 92 (FIGS. 2-3) are secured in an upright position one to each of cross bars 40. Lower cam elements 92 have outwardly flanged roller track surfaces 94 linearly sloped upwardly in a path running generally from the rear to the front sections of the device. The flanged surface provides a widened track for rollers 88 for more reliable performance. When the power assisted chair is fully retracted to a sitting position inner rollers 88 are located at the bottom of lower cam elements 92 (FIG. 5).

Opposite and laterally offset from the vertical plane of the lower cam elements 92, are dual upper cam elements 96 affixed to each upper arm 54 of the right and left irregular parallelogram linkage arms 50-52. Upper cam elements 96 are secured in depending relationship to the upper arm 54 and have inwardly flanged roller track surfaces 98 linearly sloped downwardly in a path running generally from the rear to the front sections of the device. The configuration of the inwardly flanged track 98 retains the rollers in line for more reliable tracking. When the device is retracted rollers 89 are at the top of the flanged inclined roller track 98 (FIG. 5) of upper cam elements 96. Hence, each lower cam element 92 and each upper cam element 96 is generally opposite the other, but may be offset in adjacent vertical planes. This provides roller pocket zones 100 with roller tracks 94-98 providing a generally cross configuration (FIG. 5).

By actuating motor 72, screw shaft 76 is rotated causing sleeve 78, cross shaft 82 and shaft portions 86 to advance from a retracted sitting position for the chair towards the frontal section of the device to an elevated and a forwardly tilted position (FIGS. 1-3). Rollers 88-89 thus perform as wedges in pocket zones 100 to spread and produce an elevation of upper cams 96, upper arms 54 and the chair platform 16 relative to the main frame and lower cams. Double linkage arms 50-52 are elevated causing a pivoting movement of the rear section of platform 16 in an arc-like path towards the front. During elevation rotatably mounted inner rollers 88 traveling up cam element 92 turn in a clockwise direction while rotatably mounted outer rollers 89 traveling downwardly cam element 96 turn in a counterclockwise direction. When sleeve 78 is fully extended (FIG. 3) rollers 88 are at the top of the inclined surfaces of cam elements 92 and at the bottom of cam elements 96. This action and counter rotation of the inner and outer rollers is reversed by reversing the rotation of the motor.

While the invention has been described in conjunction with various examples and embodiments, they are illustrative only. Accordingly, many alternatives, modifications and variations will be apparent to persons skilled in the art in light of the foregoing detailed description, and it is therefore intended to embrace all such alternatives, modifications and variations as to fall within the spirit and broad scope of the appended claims.

We claim:

1. A retrofittable chair lifting and tilting device which comprises lower main frame means for resting on a support surface; upper supporting platform means for engaging with a chair, said lower main frame means and upper supporting platform means having front and rear sections corresponding respectively to the front and rear of said chair; right and left linking arm means pivotally connected to the rear section of said lower main frame means and to the front section of said upper supporting platform means for forwardly tilting said upper supporting platform means as it is elevated relative to said lower main frame means; a plurality of cam means having oppositely inclined surfaces positioned between said upper supporting platform means and lower main frame means; roller means for engaging said inclined surface, and motor means for advancing said roller means and wedging apart said cam means to actuate said upper supporting platform.

2. The retrofittable chair lifting and tilting device of claim 1 wherein said right and left linking arm means comprises irregular parallelogram linkage arm means for tilting said upper supporting platform means when said cam means are wedged apart.

3. A chair in combination with the chair lifting and tilting device of claim 2.

4. The retrofittable chair lifting and tilting device of claim 2 wherein said cam means comprises a pair of spaced first cam elements with roller engaging inclined surfaces, said first cam elements mounted in dependency relationship to said parallelogram linkage arm means, and spaced second cam elements with roller engaging inclined surfaces, said second cam elements mounted upwardly to said lower main frame means.

5. The retrofittable chair lifting and tilting device of claim 4 wherein said roller engaging inclined surfaces of said first cam elements slope downwardly in a path running generally from the rear to the front sections of said upper supporting platform means and said roller inclined surfaces of said second cam elements slope upwardly in a path running generally from the rear to the front sections of said lower main frame means.

6. The retrofittable chair lifting and tilting device of claim 4 wherein said motor means comprises a pivotally mounted motor and includes a drive shaft and a cross shaft extending from said drive shaft with separate rollers for each of said first and second cam elements rotatably mounted to said cross shaft.

7. A chair in combination with the chair lifting and tilting device of claim 4.

8. A chair in combination with the chair lifting and tilting device of claim 5.

9. A chair in combination with the chair lifting and tilting device of claim 6.

10. The retrofittable chair lift and tilting device of claim 1 wherein said oppositely inclined surfaces of said cam means are positioned in the same plane and face one another.

11. The retrofittable chair lift and tilting device of claim 1 wherein said oppositely inclined surfaces of said cam means are in proximity to one another in parallel vertical planes.

12. A chair in combination with the chair lifting and tilting device of claim 1.

13. A lifting and tilting device retrofittable to a chair without requiring structural alterations to said chair, which comprises a lower main frame for resting on a supporting surface; an upper chair platform for engaging with the bottom of a chair, said lower main frame and upper chair platform having front and rear sections corresponding respectively to the front and rear of said chair; right and left irregular parallelogram linkage arms pivotally connected to the rear section of said lower main frame and front section of said upper chair platform for forwardly tilting said upper chair platform as it is elevated relative to said lower main frame; pairs of first and second cam elements having oppositely inclined surfaces laterally offset from one another, said first cam elements being spaced relative to one another and mounted in dependency relationship to said linkage arms, said second cam elements being spaced relative to one another and mounted upwardly to said lower main frame; rollers rotatably mounted on a cross shaft and spaced so each engages the inclined surface on said cam elements, and a motor and drive shaft for advancing said cross shaft and rollers for wedging apart the cam elements for actuating the upper chair platform.

14. A chair in combination with the lifting and tilting device of claim 13.

15. A retrofittable chair lifting and tilting device which comprises lower main frame means for resting on a support surface; upper supporting platform means for engaging with a chair, said lower main frame means and upper supporting platform means having front and rear sections corresponding respectively to the front and rear of said chair; right and left linking arm means pivotally connected to said lower main frame means and upper supporting platform means for forwardly tilting said upper supporting platform means as it is elevated relative to said lower main frame means; a plurality of cam pairs, each of said cam pairs comprising an upper cam and a lower cam, said upper and lower cams each having an inclined surface positioned opposite to the other between said upper supporting platform means and lower main frame means; roller means for engaging said inclined surfaces, and motor means for advancing said roller means and wedging apart each of said cam pairs to actuate said upper supporting platform.

16. The retrofittable chair lifting and tilting device of claim 15 wherein said right and left linking arm means comprises irregular parallelogram linkage arm means for tilting said upper supporting platform means when said cam pairs are wedged apart.

17. The retrofittable chair lifting and tilting device of claim 16 wherein said cam pairs comprise spaced upper cam elements with roller engaging inclined surfaces mounted in dependency relationship to said parallelogram linkage arm means, and spaced lower cam elements with roller engaging inclined surfaces, mounted upwardly to said lower main frame means.

18. The retrofittable chair lifting and tilting device of claim 17 wherein said roller engaging inclined surfaces of said upper cam elements slope downwardly in a path running generally from the rear to the front sections of said upper supporting platform means and said roller inclined surfaces of said lower cam elements slope upwardly in a path running generally from the rear to the front sections of said lower main frame means.

19. A chair in combination with the chair lifting and tilting device of claim 15.

* * * * *